US012728494B2

(12) United States Patent
Scriven

(10) Patent No.: US 12,728,494 B2
(45) Date of Patent: Sep. 8, 2026

(54) SKI BASE EDGE SHARPENER HOUSING AND COMPONENTS

(71) Applicant: Razor Tune LLC, Waterford, NY (US)

(72) Inventor: Troy Harrison Scriven, Waterford, NY (US)

(73) Assignee: Razor Tune LLC, Waterford, NY (US)

( * ) Notice: Subject to any disclaimer, the term of this patent is extended or adjusted under 35 U.S.C. 154(b) by 378 days.

(21) Appl. No.: 18/517,652

(22) Filed: Nov. 22, 2023

(65) Prior Publication Data

US 2025/0162097 A1 May 22, 2025

(51) Int. Cl.
*B24B 3/00* (2006.01)
*A63C 11/06* (2006.01)

(52) U.S. Cl.
CPC ..... *B24B 3/006* (2013.01); *A63C 11/06* (2013.01)

(58) Field of Classification Search
CPC ..... B24B 3/006; A63C 11/06
See application file for complete search history.

(56) References Cited

U.S. PATENT DOCUMENTS 5,136,816 A * 8/1992 Beckingham ..... A63C 11/06 451/484
6,702,656 B1 * 3/2004 Hibbert ..... A63C 11/06 451/344
2010/0330889 A1 * 12/2010 Thibault ..... A63C 11/06 280/809

FOREIGN PATENT DOCUMENTS

CA 2783692 A1 * 2/2014 ..... A63C 11/06
CH 646611 A5 * 12/1984 ..... B24B 3/006

OTHER PUBLICATIONS

Machine translation of CH-646611-A5, Farcinade et al, published in Dec. 14, 1984 (Year: 1984).*
Razor-Tune "Razor-Tune Li-ion Battery Kit with Charger," product webpage https://razor-tune.com/products/razor-tune-li-ion-battery-pack (last accessed May 1, 2026).

* cited by examiner

*Primary Examiner* — Nathaniel E Wiehe
*Assistant Examiner* — Jason G Davis
(74) *Attorney, Agent, or Firm* — Workman Nydegger

(57) ABSTRACT

An edge sharpening device comprises an electric motor housed by a housing. A motor shaft extends from the electric motor and is rotatable by the electric motor about a rotation axis. The motor shaft is configured to secure an abrasive wheel. The housing comprises a housing base configured to secure a base adapter. The base adapter is configured to rest on a surface of a material comprising an edge to enable the abrasive wheel to contact the edge. The housing also comprises a battery mount configured to secure a battery for powering the electric motor. A longitudinal axis of the housing base, a longitudinal axis of the battery mount, and the rotation axis of the electric motor are arranged on a median plane of the edge sharpening device.

16 Claims, 12 Drawing Sheets

200

200

200

200

200

200

SKI BASE EDGE SHARPENER HOUSING AND COMPONENTS

BACKGROUND

Skiing is a popular winter sport enjoyed by enthusiasts of various skill levels. Skiing involves gliding down snow-covered slopes using skis that are attached to boots.

Each ski includes a ski base (or simply "base"), which is the lowermost surface of the ski that comes into direct contact with the snow. Ski bases are typically constructed from a durable and low-friction material, such as sintered polyethylene or hardened metal edges, to enable the ski base to withstand the challenges of various snow conditions while still exhibiting high gliding efficiency. Maintaining ski bases can enable them to achieve their best performance, longevity, and/or safety while skiing. One aspect of ski base maintenance is ski edge tuning, which involves sharpening the edges of the ski to enable the ski to maintain control, turning ability, and responsiveness.

Ski edge sharpening (or tuning) is associated with numerous challenges. For instance, novice tuners can find difficulty in achieving consistent edge characteristics (e.g., sharpening angle(s)) across the entire length of the ski. To achieve desirable tuning results, skiers often need to invest significant time to develop high levels of skill and/or experience in tuning ski edges. Various tools have been developed to assist skiers in performing ski edge tuning. However, such tools are typically prohibitively expensive and/or difficult to use properly without first developing significant experience.

Some skiers rely on ski maintenance experts for ski tuning services. However, such services can be expensive and/or difficult to schedule or coordinate, which can reduce the amount of time that skiers are able to spend on the slopes.

The subject matter described herein is not limited to embodiments that solve any challenges or that operate only in environments such as those described above. Rather, this background is only provided to illustrate one example technology area where some embodiments described herein may be practiced.

BRIEF DESCRIPTION OF THE DRAWINGS

Reference will be made to embodiments of the disclosure, examples of which may be illustrated in the accompanying figures. These figures are intended to be illustrative, not limiting. Although the disclosure is generally described in the context of these embodiments, it should be understood that it is not intended to limit the scope of the disclosure to these particular embodiments. Items in the figures are not necessarily drawn to scale.

DETAILED DESCRIPTION

Figure 1:
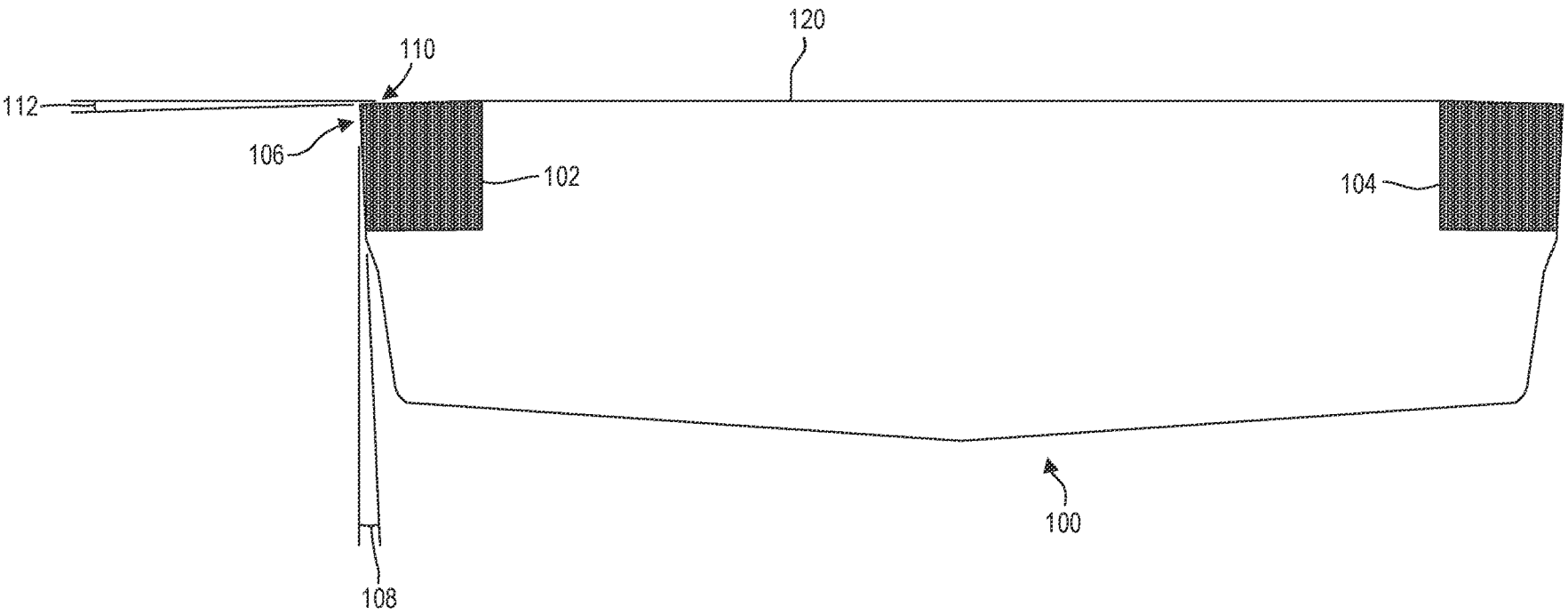
FIG. 1 illustrates a conceptual representation of a ski base with edges that can be sharpened.

The disclosed subject matter relates to edge sharpening devices.

At least some disclosed embodiments are directed to a motor-driven edge sharpening system that is adapted for sharpening or tuning of the edges of ski bases. The motor can be configured to cause rotation of an abrasive wheel that can interface with the edge of a ski base to tune the edge. The abrasive wheel (and motor) can be configured to translate along an axis of the edge sharpening device and can be biased by one or more springs along the axis, enabling the abrasive wheel to maintain a desired level of contact with the edge throughout the sharpening process. The edge sharpening device can include guide bearings positioned proximate to the abrasive wheel, which can enable users to easily align the abrasive wheel with the edge and move the edge sharpening device along the full length of the edge during sharpening.

The edge sharpening device can be adaptable to operate in a side bevel sharpening configuration or a base bevel sharpening configuration. The edge sharpening device may receive an angle plate on a housing base thereof to assume the side bevel sharpening configuration. When in the side bevel sharpening configuration, the angle plate can be configured to rest on and slide across a ski base to facilitate sharpening of the side bevel of the ski base. Different angle plates may be interchangeably used to achieve different side bevel sharpening angles.

In some implementations, the motor, the angle plate, and a battery of the edge sharpening device form a vertical arrangement over the ski base during side bevel sharpening, causing the center of gravity of the edge sharpening device to be arranged over the ski base. Such a configuration can improve the balance and ease of use of the edge sharpening device to perform side bevel sharpening.

The edge sharpening device may receive a base bevel adapter on the housing base to assume the base bevel sharpening configuration. When in the base bevel sharpening configuration, the base bevel adapter can be configured for positioning on and sliding across the ski base to facilitate sharpening of the base bevel of the ski base. The base bevel can include an adjustment feature to achieve different base bevel sharpening angles.

In some instances, the abrasive wheel has an abrasive side and a non-abrasive side. The abrasive wheel can be reversed to achieve different sharpening configurations. For instance, the abrasive side of the abrasive wheel may face toward the motor in the side bevel sharpening configuration, whereas the abrasive side of the abrasive wheel may face away from the motor in the base bevel sharpening configuration. In some instances, the abrasive wheel has two abrasive sides to achieve different sharpening configurations without reversing the position of the abrasive wheel.

In some implementations, the biasing of the abrasive wheel (and motor) along the translation axis of the motor may be reversed for the different sharpening configurations. For instance, the abrasive wheel may be biased in a first direction for the side bevel sharpening configuration, whereas the abrasive wheel may be biased in an opposite, second direction for the base bevel sharpening configuration.

The angle plate(s) and the base bevel adapter may be provided in conjunction with the edge sharpening device as an edge sharpening system or kit, enabling users to readily reconfigure the edge sharpening device to sharpen different bevels of the edges of ski bases.

Additional features and aspects of an example edge sharpening device will be shown and described in more detail hereinbelow. Various features of an edge sharpening device, according to the disclosed subject matter, can achieve various benefits relative to conventional ski base edge sharpening devices, methods, and techniques. For instance, the motorized operation, the spring biasing features, and/or the alignment features (e.g., the guide bearings, the angle plates, the base bevel adapter) can enable users to easily achieve consistent sharpening over the entire edge of a ski base. Implementation of such features can thus facilitate improved performance and/or longevity of ski bases, reduce difficulties associated with maintenance of the ski base, and enable individuals to spend more time on the slopes.

Example Edge Sharpening Systems, Devices, and Components

FIG. 1 illustrates a conceptual representation of a ski base 100 with edges 102 and 104 that can be sharpened. The ski base 100 of FIG. 1 is shown in transverse cross-section and in an up-side down configuration typically utilized to perform sharpening of ski bases, with a bottom surface 120 of the ski base 100 facing upward. FIG. 1 illustrates a side bevel 106 of edge 102, which is associated with a side bevel angle 108. The side bevel angle 108 is applied to the vertical edge of the ski base 100 and contributes to edge grip and the ability of the ski base 100 to initiate and hold turns. Larger side bevel angles 108 (e.g., 3 degrees) can result in a sharper edge, providing enhanced edge grip for more aggressive and/or precise turns. Smaller side bevel angles (e.g., 1 degree) can make the edge less aggressive, which can be suitable for skiers who prefer smoother turns or encounter softer snow conditions.

FIG. 1 also illustrates a base bevel 110 of edge 102, which is associated with a base bevel angle 112. The base bevel angle 112 is applied to the horizontal edge of the ski base 100 and influences how much the ski base 100 can be tilted before the edges 102 and/or 104 come into contact with the snow. A larger base bevel angle 112 (e.g., 1 degree) can allow for smoother turns and easier steering. Smaller base bevel angles (e.g., 0.5 degrees) can result in a more aggressive edge engagement, which can be suitable for expert skiers or those seeking greater control at high speeds.

Figure 2:
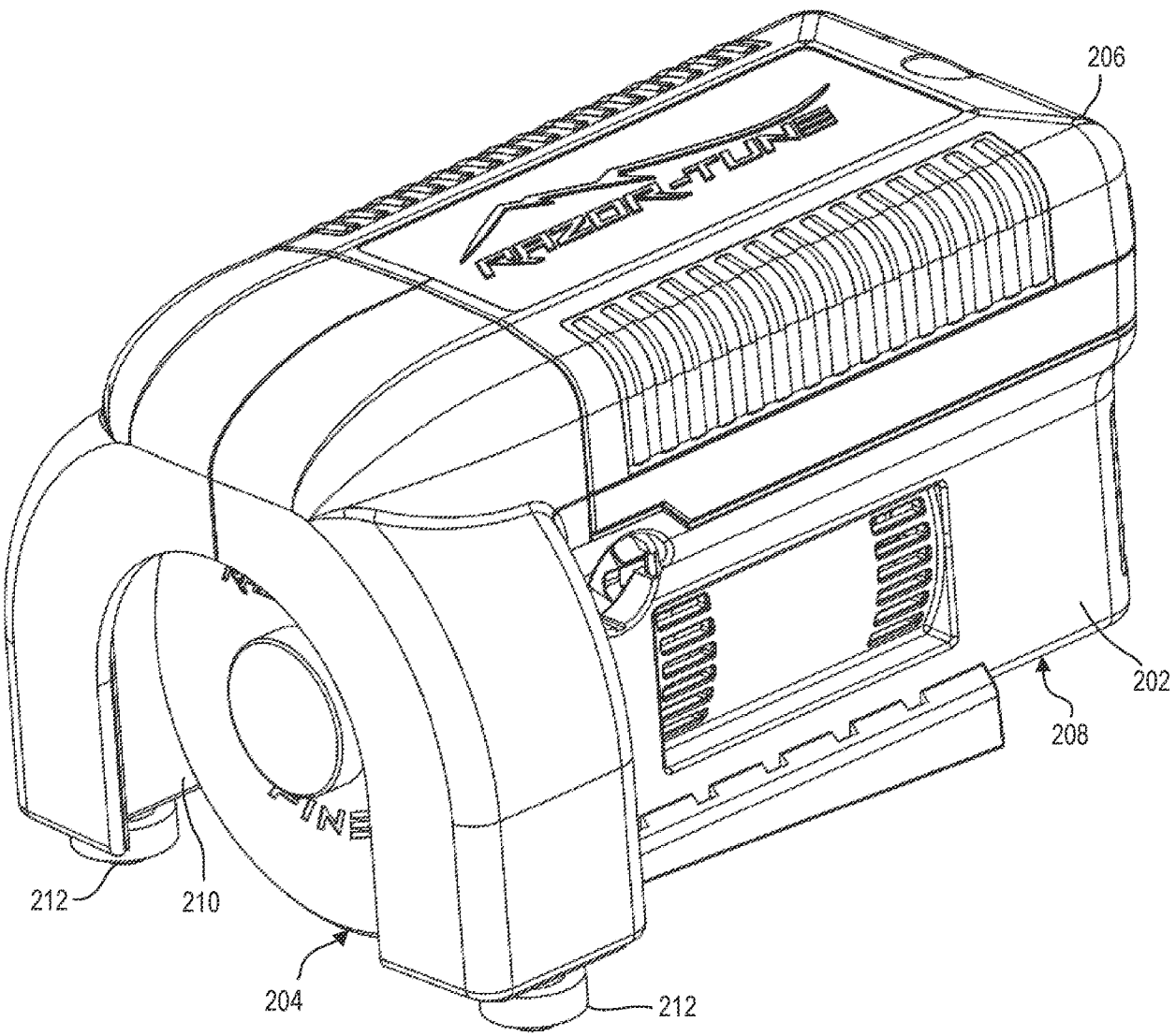
FIG. 2 illustrates a perspective view of an example edge sharpening device, in accordance with implementations of the disclosed subject matter.

The edges 102 and 104 of a ski base 100 can be regularly tuned or sharpened to maintain desirable performance of the ski base 100. FIG. 2 illustrates a perspective view of an example edge sharpening device 200, which may be used to facilitate sharpening of the edges 102 and 104 of a ski base 100. Although examples shown and/or described herein focus, in at least some respects, on sharpening edges of a ski base, the principles and/or components described herein may be applied to devices for sharpening other types of edges and/or materials.

The edge sharpening device 200 of FIG. 2 includes a housing 202 that houses and/or supports various other components of the edge sharpening device 200. The edge sharpening device 200 includes an abrasive wheel 204 that can rotate to achieve edge sharpening. The abrasive wheel 204 of FIG. 2 is connected to a motor shaft that extends from an electric motor for rotating the abrasive wheel 204 (see FIG. 3). In the example of FIG. 2, the edge sharpening device 200 includes a battery 206 for powering the electric motor (though other powering means may be utilized, such as a cord connectable to an electrical outlet or other power source).

The edge sharpening device 200 of FIG. 2 also includes other components for facilitating edge sharpening. For instance, the housing 202 of the edge sharpening device 200 includes a housing base 208 that is configured to receive a base adapter. In some implementations, a base adapter for an edge sharpening device 200 is configured to rest on or otherwise interface with a surface of a material (e.g., bottom surface 120 of ski base 100) to enable the abrasive wheel 204 to contact an edge of the material (e.g., edges 102 and/or 104). As used herein, a base adapter "resting" on a material indicates that the base adapter achieves a state of stable and balanced positioning atop the material without the need for external or assistive forces to maintain the positioning (e.g., gravitational force of the edge sharpening device 200 and normal force of the material are sufficient to maintain the positioning, such as when the material is substantially horizontally positioned).

In some instances, the housing base 208 is able to receive and secure multiple types of base adapters, and the base adapters can be selectively removable from the housing base 208. In some implementations, base adapters for connection to a housing base 208 can take on various forms. For instance, a base adapter for an edge sharpening device 200 can comprise an angle plate (shown in FIG. 2), a base bevel adapter, and/or others. In some instances, some base adapters (e.g., angle plates) can enable the edge sharpening device 200 to rest on a material to facilitate sharpening of an edge thereof (see FIG. 5), whereas other base adapters (e.g., base bevel adapters) cause the edge sharpening device 200 to rely on external or assistive forces (e.g., user manipulation) to maintain positioning on the material to facilitate sharpening of an edge thereof (see FIG. 9).

In the example of FIG. 2, the edge sharpening device 200 also includes a spark shield 210, which can shield users and/or other components of the edge sharpening device 200 from sparks emitted during sharpening of an edge via the abrasive wheel 204. The edge sharpening device 200 of FIG. 2 also includes guide bearings 212, which can assist users in controlling the edge sharpening device 200 to travel along a ski base 100 (or other material) while maintaining contact between the abrasive wheel 204 and the ski base 100 to accomplish sharpening of edges 102 and/or 104 of the ski base 100.

Figure 3:
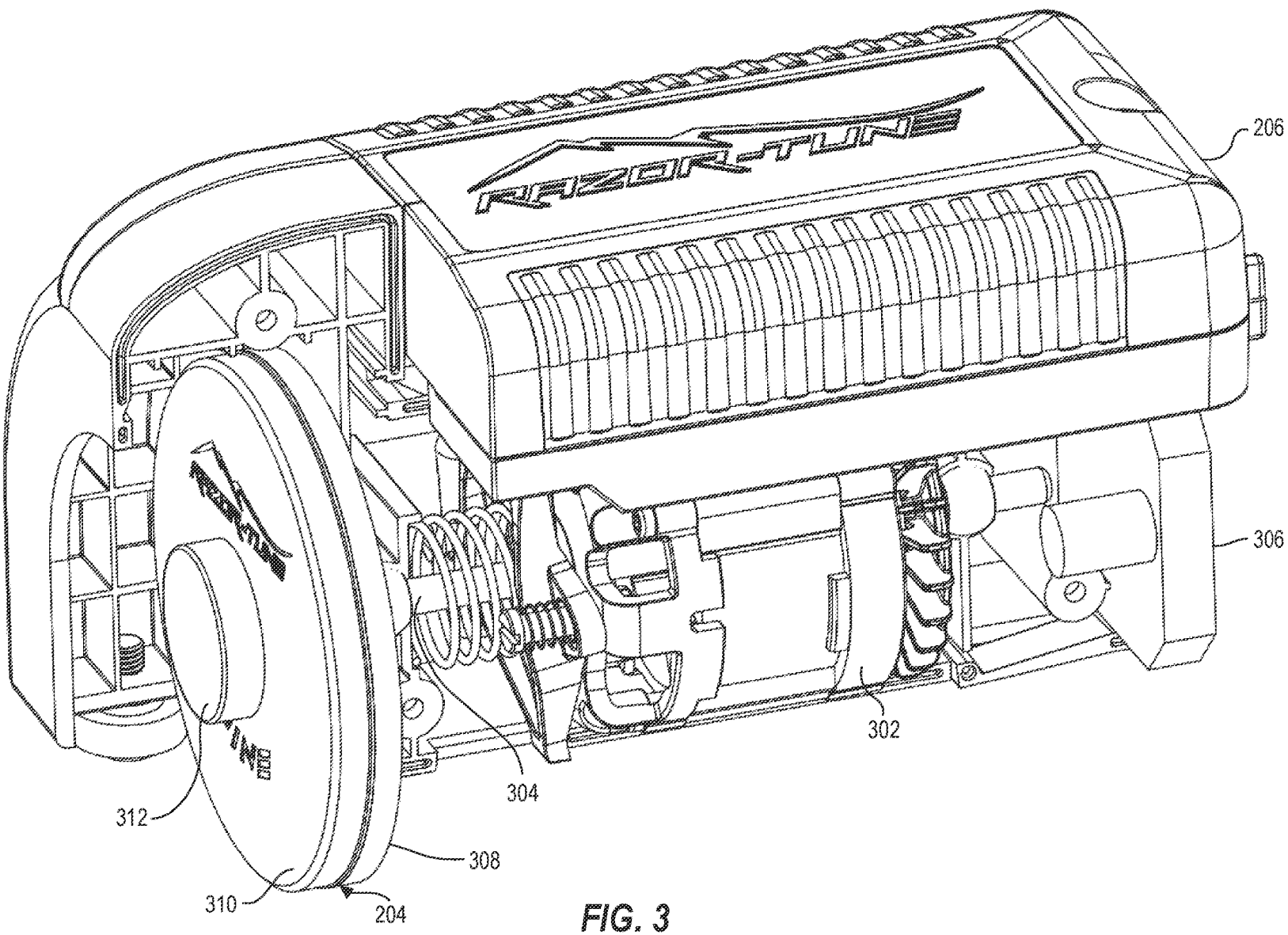
FIG. 3 illustrates an example edge sharpening device with various components removed therefrom to illustrate interior features of the edge sharpening device.

FIG. 3 illustrates the edge sharpening device 200 with the base adapter and a side component of the housing 202 removed to illustrate interior features of the edge sharpening device 200. In particular, FIG. 3 illustrates the electric motor 302 of the edge sharpening device 200 and shows the motor shaft 304 extending from the electric motor 302. As noted above, the abrasive wheel 204 can secure to the motor shaft 304 to enable the abrasive wheel 204 to be rotationally driven by the electric motor 302 to accomplish edge sharpening.

In some implementations, the electric motor 302 is a brushless DC motor powered by the battery 206, though other types of motors may be utilized in accordance with the disclosed subject matter. FIG. 3 also illustrates a motor controller 306 of the edge sharpening device 200, which can be configured to control operation of the electric motor 302. In some instances, the motor controller 306 is in communication with a motor speed detection element (not shown) that is configured to determine a rotation speed of the electric motor 302 (or the abrasive wheel 204). The motor speed detection element can take on various forms, such as a tachometer (mechanical or digital), an encoder, a resolver, a hall effect sensor, a stroboscope, a frequency counter, an infrared sensor, a vibration sensor, a current or power sensor, an EMF or back EMF sensor, a dynamometer, and/or others.

Based on output of or a signal from the motor speed detection element, the motor controller 306 may control the voltage or current supplied to the electric motor 302. Such functionality can enable the motor controller 306 to facilitate active speed control for the electric motor 302 and abrasive wheel 204 to implement a target rotation speed for the electric motor 302 and the abrasive wheel 204. In some implementations, the target rotation speed is selected based on the diameter of the abrasive wheel 204 to achieve a desired contact speed for the abrasive wheel 204 on the edge being sharpened. For example, the target rotation speed can be within a range of about 3,000 to about 15,000 rpm, depending on the size of the abrasive wheel 204. Smaller abrasive wheel 204 diameters can be associated with higher target rotation speeds, whereas larger abrasive wheel 204 diameters can be associated with lower target rotation speeds. For the example edge sharpening device 200 of FIG. 3, the target rotation speed may be about 6,500 rpm.

The implementation of active speed control via the motor controller 306 can contribute to improved edge sharpening, such as by achieving consistency in sharpening parameters over the length of the edge being sharpened. The motor controller 306 can utilize various control frameworks to achieve active speed control as described above, such as proportional-integral-derivative (PID) control, model predictive control (MPC), adaptive control, state feedback control, neural network control, and/or others.

In some implementations, upon powering up of the electric motor 302 of the edge sharpening device 200, the motor controller 306 implements a high-torque start routine. Such functionality can beneficially adapt the edge sharpening device 200 for starting up with a load already present on the abrasive wheel 204. For instance, a user may position the edge sharpening device 200 on a ski base 100, bring the abrasive wheel 204 into initial contact with the side bevel 106 of the ski base 100, and continue to force the abrasive wheel 204 toward the side bevel 106 to counteract the internal biasing spring of the edge sharpening device 200 until the guide bearings 212 contact the side of the ski base 100 (or the ski of which the ski base 100 is a part) (see FIG. 5). Such a positioning can cause a load to be present on the abrasive wheel 204. Under such positioning, the electric motor 302 may be powered up. Without a high-torque start routine, the electric motor 302 may encounter difficulty in attempting to overcome static friction to implement active speed control with the abrasive wheel 204 (and electric motor 302) in the preloaded state noted above (particularly when the electric motor 302 is implemented as a brushless DC motor).

Accordingly, the motor controller 306 may implement a high-torque start routine to account for the preloaded state of the abrasive wheel 204 (and electric motor 302) prior to implementing active speed control as described above. The high-torque start routine may comprise driving the electric motor 302 at a high current setting until a transition condition is satisfied. The transition condition may comprise elapsing of a predetermined time period (e.g., within a range of about 0.25 seconds to about 1.5 seconds) or reaching of the target rotation speed (referenced above) after startup. After the transition condition is satisfied, the motor controller 306 may transition to the active speed control framework discussed hereinabove to continue driving the electric motor 302 to facilitate edge sharpening.

FIG. 3 furthermore illustrates that, in some implementations, the abrasive wheel 204 includes an abrasive side 308 and a non-abrasive side 310. In other implementations, both sides of the abrasive wheel 204 can include abrasives. In some instances, the abrasive wheel 204 is selectively connectable to and removable from the motor shaft 304, such as via a thumb knob 312 as shown in FIG. 3. Such functionality can enable users to reverse the positioning of the abrasive wheel 204 relative to the electric motor 302 to achieve different bevel sharpening modes/configurations. For instance, in a side bevel sharpening configuration, the abrasive wheel 204 may be affixed to the motor shaft 304 with the abrasive side 308 facing toward the electric motor 302 (e.g., facing toward a first direction), whereas, in a base bevel sharpening configuration, the abrasive wheel 204 may be affixed to the motor shaft 304 with the abrasive side 308 facing away from the electric motor 302 (e.g., facing toward a second direction).

Figure 4:
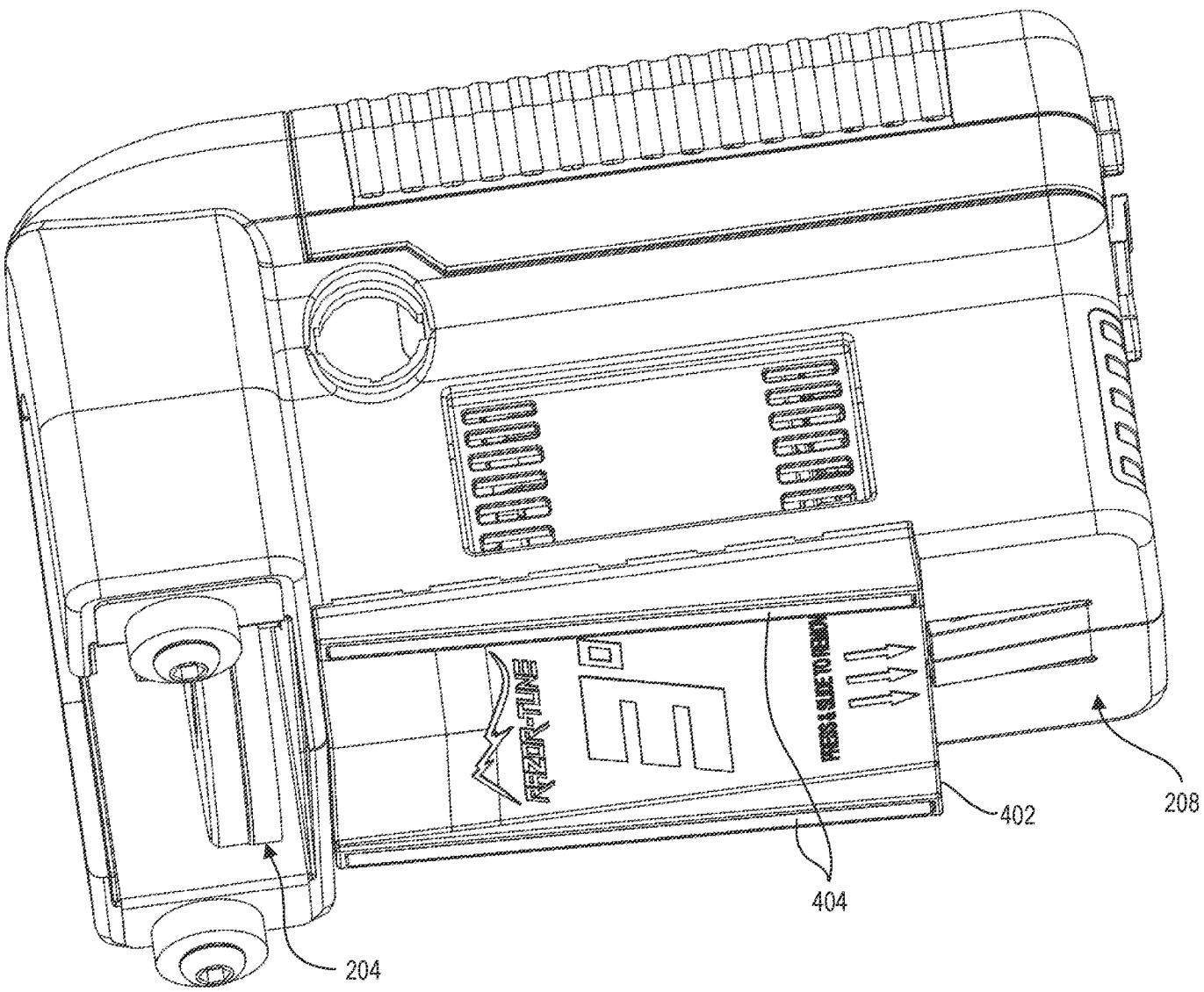
FIG. 4 illustrates a bottom perspective view of an example edge sharpening device, illustrating an angle plate connected to the housing base thereof.

FIG. 4 illustrates a bottom perspective view of the edge sharpening device 200 with an angle plate 402 connected to the housing base 208. The configuration of the edge sharpening device 200 with the angle plate 402 secured to the housing base 208 and with the abrasive wheel 204 connected to the motor shaft 304 with the abrasive side 308 facing toward the electric motor 302 may be regarded as a side bevel sharpening configuration or mode. The angle plate 402 can be configured to rest on a surface of a material (e.g., bottom surface 120 of ski base 100) to allow the abrasive wheel 204 to contact a side bevel of the material (e.g., side bevel 106) at a desired side bevel sharpening angle.

In the example of FIG. 4, the angle plate 402 includes slide rails 404 that are adapted to interface with the surface of a material (e.g., bottom surface 120 of ski base 100) for sharpening of a side bevel of the material (e.g., side bevel 106). The slide rails 404 may comprise elongated, smooth, and arcuate surfaces that enable the angle plate 402 (and edge sharpening device 200 connected thereto) to slide across the material with mitigated friction and in a manner that reduces the potential for scratching. In the case of a ski base 100, the slide rails 404 can enable the angle plate 402 to follow the curvature of the ski base 100 and maintain desired contact at the tip and tail regions of the ski base 100.

Figure 5:
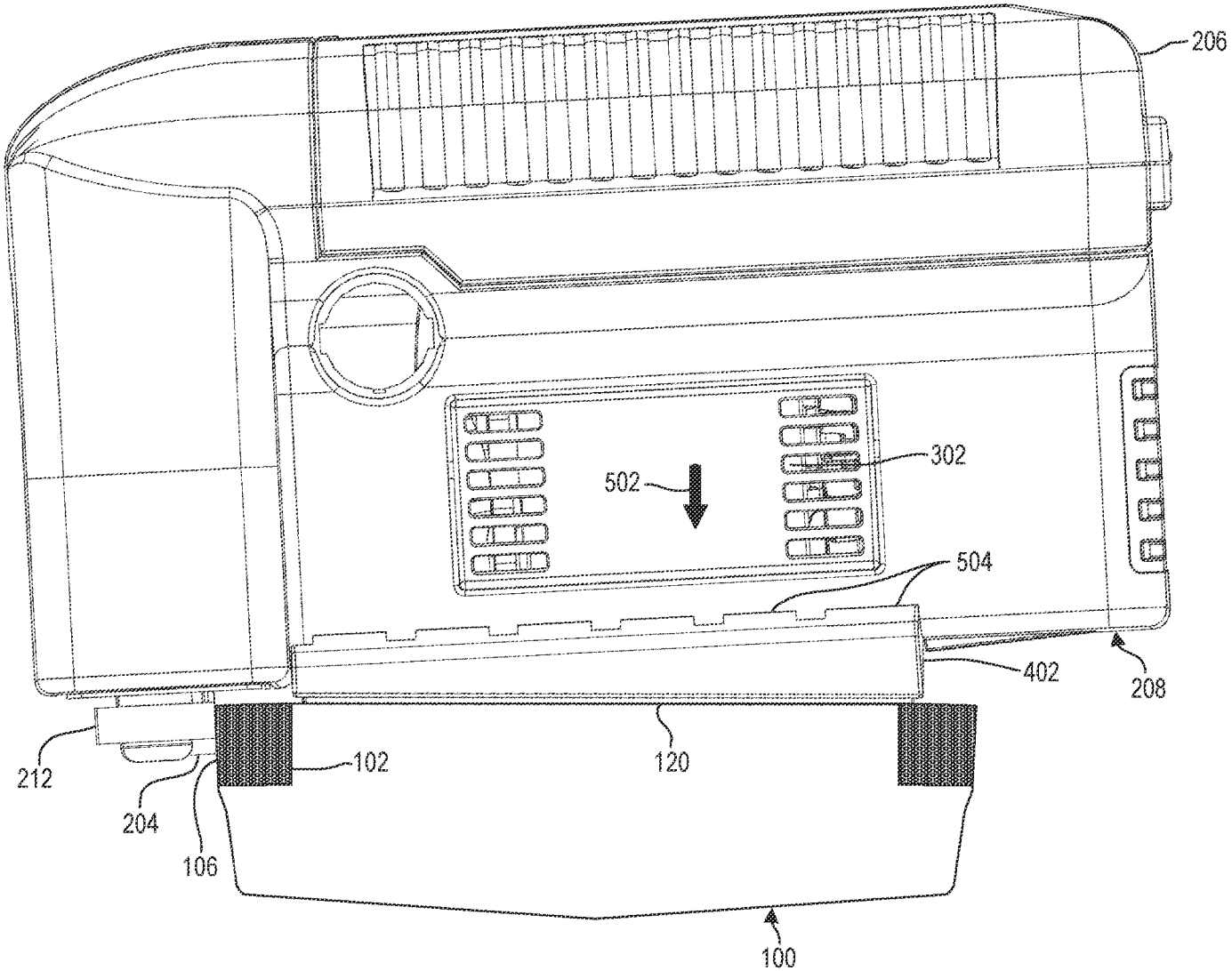
FIG. 5 illustrates a conceptual representation of an example edge sharpening device being used to sharpen a side bevel of an edge of a ski base.

FIG. 5 illustrates a conceptual representation of the edge sharpening device 200 as represented in FIG. 4 being used to sharpen the side bevel 106 of the edge 102 of the ski base 100. In particular, FIG. 5 shows the angle plate 402 resting on the bottom surface 120 of the ski base 100 and shows the abrasive wheel 204 contacting the side bevel 106 of the ski base 100 so as to sharpen the side bevel 106 in accordance with a desired side bevel angle 108. The guide bearings 212 are also brought into contact with the side of the ski base 100 (or the side of the ski generally), allowing an internal biasing spring of the edge sharpening device 200 to force the abrasive wheel 204 against the side bevel 106 for improved tuning/sharpening.

Advantageously, under the configuration shown in FIG. 5 (i.e., with the angle plate 402 resting on the ski base 100 and with the abrasive wheel 204 in contact with the edge 102), the housing base 208, the electric motor 302, and the battery 206 (or battery mount holding the battery) form a vertical arrangement (e.g., vertical stack) over the bottom surface 120 of the ski base 100. A center of gravity 502 of the edge sharpening device 200 may thus be positioned over the bottom surface 120 of the ski base 100. Such a configuration can improve ease of use as a user causes the edge sharpening device 200 to travel along the length of the ski base 100 (while maintaining contact between the guide bearings 212 and the side of the ski base 100 or ski) to allow the abrasive wheel 204 to sharpen the length of the side bevel 106 (being forced thereagainst by a spring system of the edge sharpening device 200).

Figure 6:
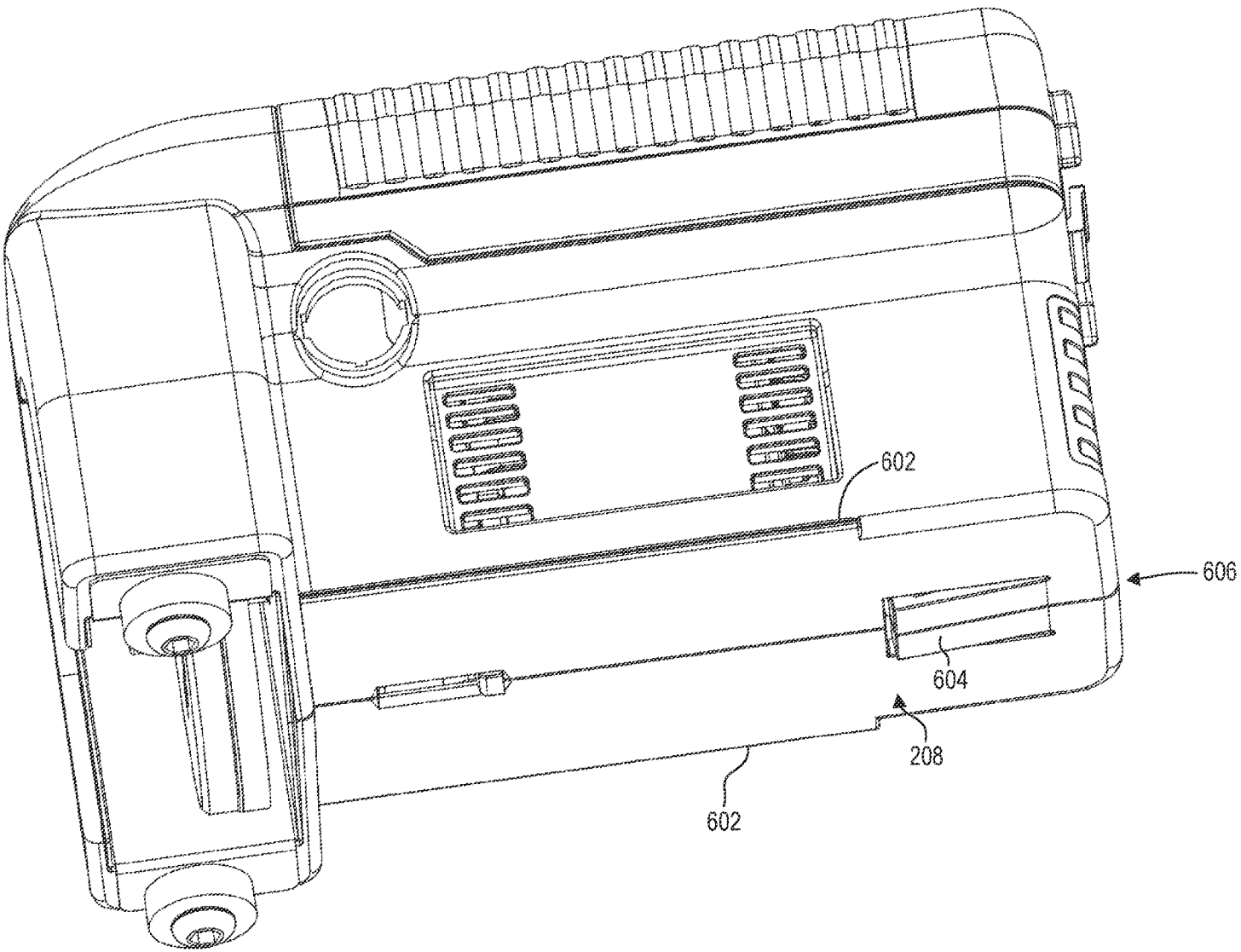
FIG. 6 illustrates a bottom perspective view of an example edge sharpening device with no base adapter connected to the housing base thereof.

As noted above, a housing base 208 may be configured to selectively secure and disengage from base adapters, such as the angle plate 402 shown in FIGS. 4 and 5. For example, FIG. 6 illustrates a bottom perspective view of the edge sharpening device 200 with no base adapter connected to the housing base 208. In the example of FIG. 6, the housing base 208 includes rims 602 and a retention member 604 for securing different base adapters (e.g., angle plates, base bevel adapters, etc.).

To secure the angle plate 402 to the housing base 208, the angle plate 402 may be advanced along the housing base 208 from a rear 606 of the housing base 208. Slots 504 (see FIG. 5) of the angle plate 402 may at least partially encompass and engage with the rims 602 of the housing base 208 as the angle plate 402 advances along the housing base 208 from the rear 606. Furthermore, as the angle plate 402 advances along the housing base 208 from the rear 606, the angle plate 402 may depress the retention member 604 into the edge sharpening device 200. The retention member 604 may be biased outward from the edge sharpening device 200 such that, when the angle plate 402 reaches a final position after advancement along the housing base 208 from the rear 606, the retention member 604 re-protrudes outward from the edge sharpening device 200 and retains the angle plate 402 in its final position (the final position being shown in FIGS. 4 and 5). To selectively remove the angle plate 402 from the housing base 208, a user may manually depress the retention member 604 and withdraw the angle plate 402 over the depressed retention member 604 toward the rear 606.

One will appreciate, in view of the disclosed subject matter, that other componentry for facilitating selective engagement and disengagement between a housing base 208 and various base adapters are within the scope of the present disclosure (e.g., with slots being arranged on the housing base rather than the base adapters, or with other connection schema such as magnetic connections, fastener-based connections, and/or others).

Figure 7:
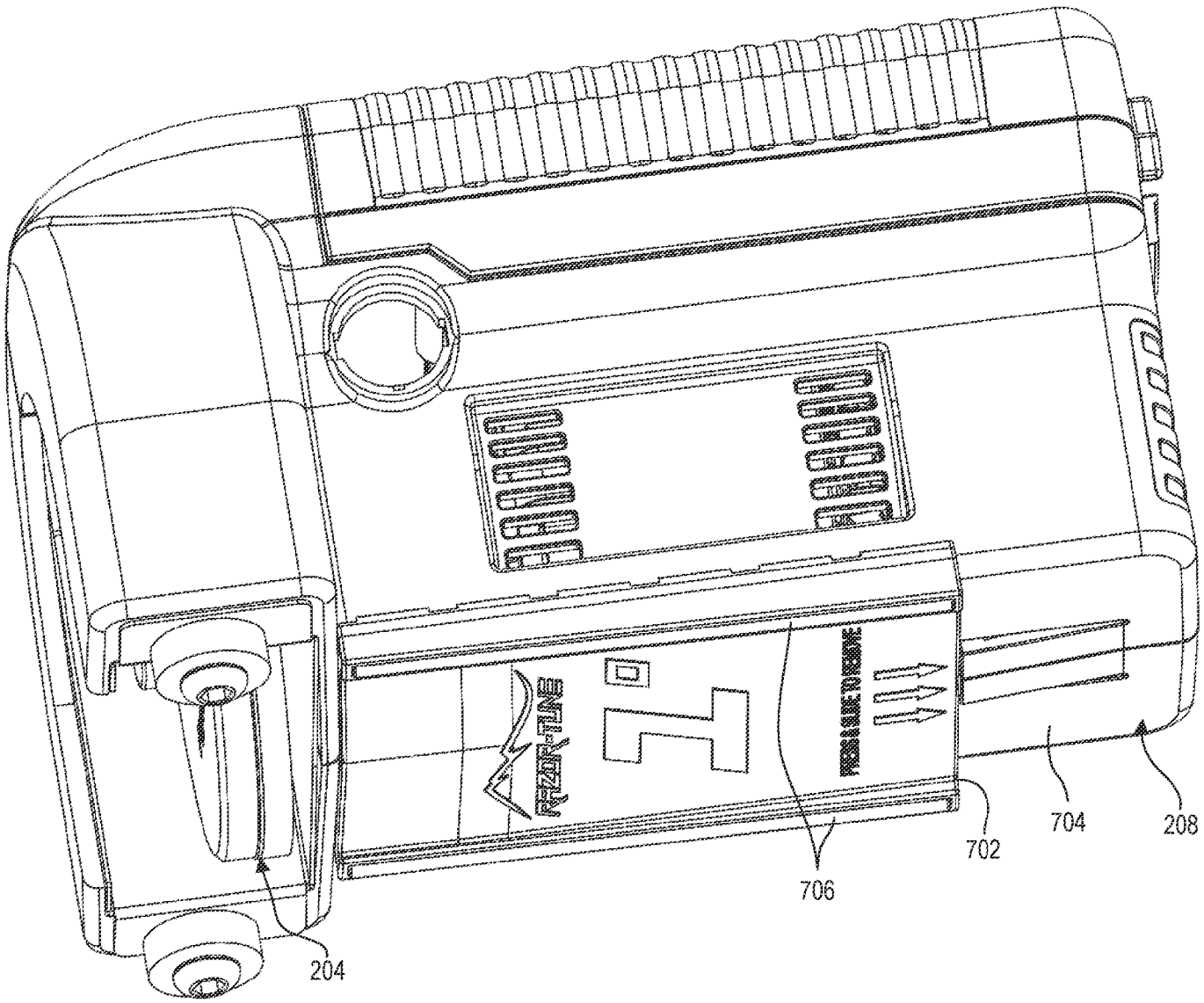
FIG. 7 illustrates a bottom perspective view of an example edge sharpening device with a different angle plate connected to the housing base thereof.

As noted above, the housing base 208 of an edge sharpening device 200 can be configured to alternately secure multiple different base adapters, such as base adapters other than the angle plate 402 shown in FIGS. 4 and 5. FIG. 7 illustrates a bottom perspective view of the edge sharpening device 200 with a different angle plate 702 connected to the housing base 208. The different angle plate 702 is associated with a different side bevel sharpening angle than the angle plate 402. For instance, the different angle plate 702 forms a smaller angle between the bottom surface 704 of the housing base 208 and the slide rails 706 of the different angle plate 702. Thus, when the edge sharpening device 200 with the different angle plate 702 is positioned on a ski base 100 to sharpen a side bevel 106 thereof, the different angle plate 702 would cause the abrasive wheel 204 to contact the side bevel 106 at a smaller side bevel sharpening angle.

Accordingly, an edge sharpening device 200 can be configured to selectively receive different angle plates to achieve different side bevel sharpening angles. In some implementations, an edge sharpening device 200 is provided (e.g., shipped) to users as an edge sharpening system with a plurality of different angle plates associated with different side bevel sharpening angles, thereby enabling users to readily reconfigure the edge sharpening device 200 for different side bevel sharpening angles.

Figure 8:
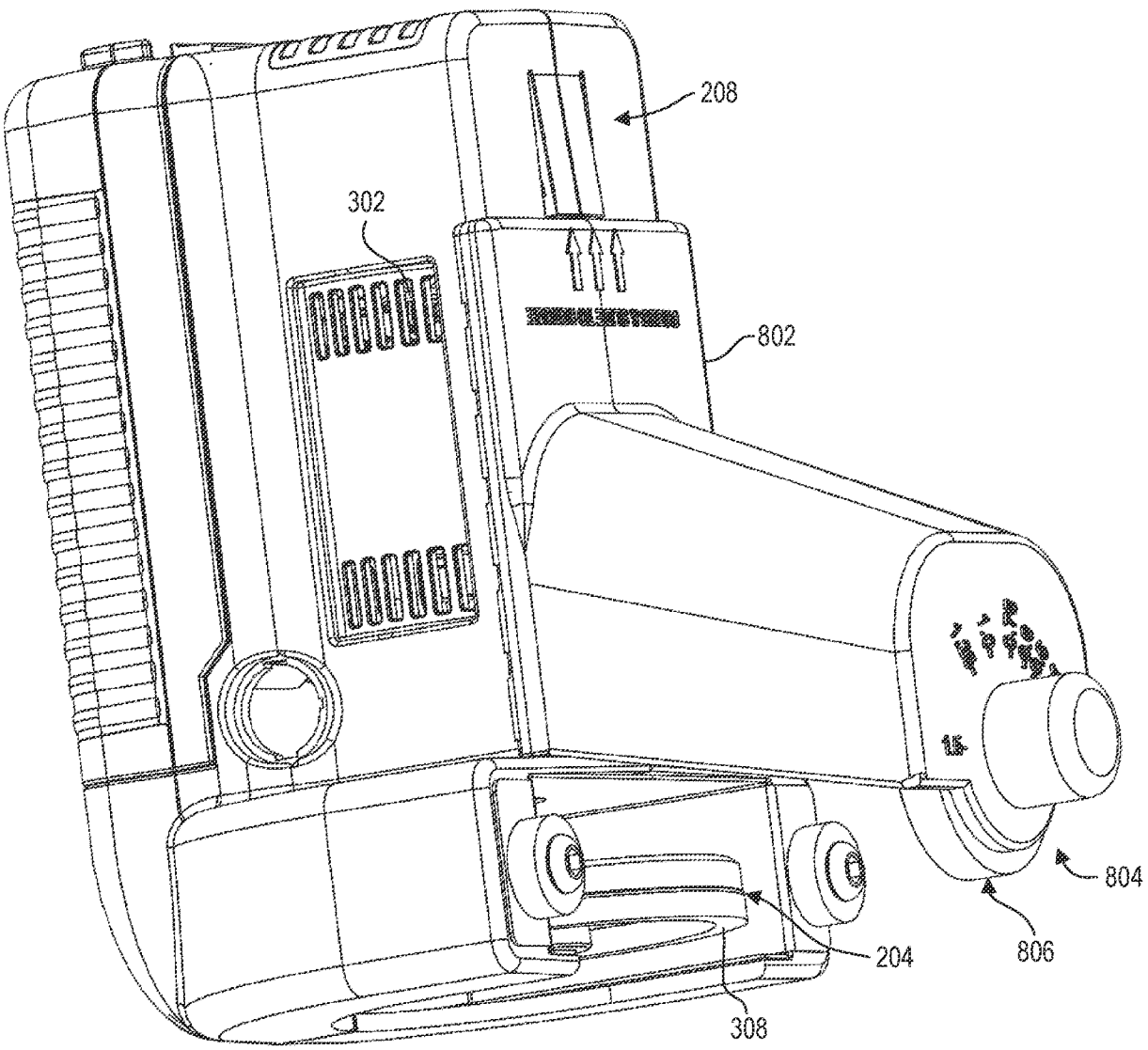
FIG. 8 illustrates a perspective view of an example edge sharpening device with a base bevel adapter connected to the housing base thereof.

As noted above, the housing base 208 of the edge sharpening device 200 can be configured to receive different types of base adapters other than angle plates as shown in FIGS. 4, 5, and 7. FIG. 8 illustrates a perspective view of the edge sharpening device 200 with a base bevel adapter 802 connected to the housing base 208. The base bevel adapter 802 may be selectively connected to the housing base 208 in a manner similar to that described hereinabove with reference to FIG. 6. FIG. 8 also illustrates the abrasive wheel 204 positioned on the edge sharpening device 200 with the abrasive side 308 thereof facing away from the electric motor 302. The configuration of the edge sharpening device 200 with the base bevel adapter 802 secured thereto and with the abrasive side 308 of the abrasive wheel 204 facing away from the electric motor 302 may be regarded as a base bevel sharpening configuration.

The base bevel adapter 802 of FIG. 8 is configured to interface with the surface of a material (e.g., bottom surface 120 of ski base 100) to enable the abrasive wheel 204 to contact a base bevel of the material (e.g., base bevel 110) at a desired base bevel sharpening angle. In the example of FIG. 8, the base bevel adapter 802 includes an angle adjustment cam 804 that is rotatable to modify the height of the contact region 806 of the base bevel adapter 802 (e.g., relative to the guide bearings 212). By adjusting the height of the contact region 806, the base bevel sharpening angle at which the abrasive wheel 204 contacts the base bevel 110 of the ski base 100 may be adjusted.

Figure 9:
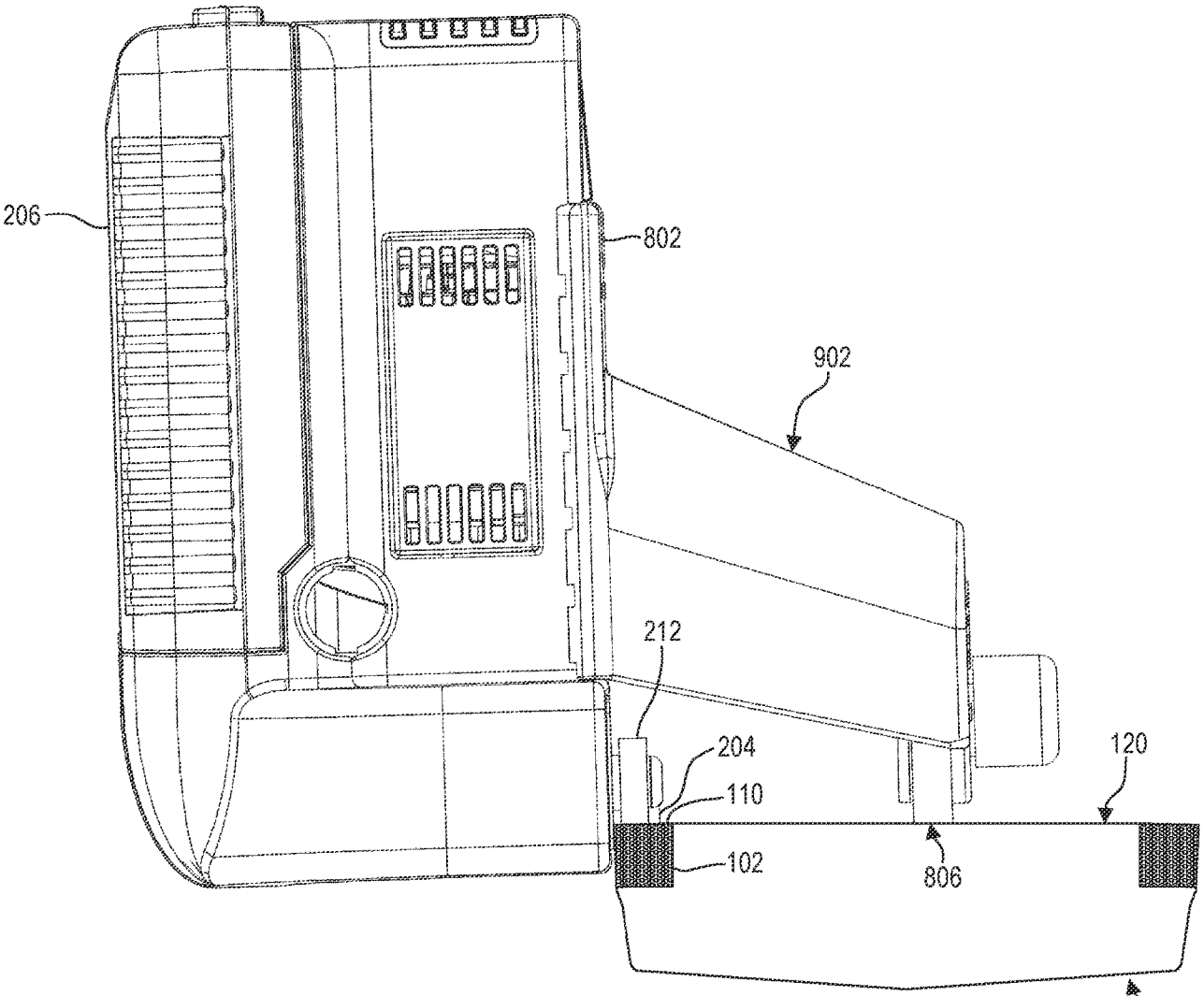
FIG. 9 illustrates a conceptual representation of an example edge sharpening device being used to sharpen a base bevel of an edge of a ski base.

FIG. 9 illustrates a conceptual representation of the edge sharpening device 200 as represented in FIG. 8 being used to sharpen the base bevel 110 of 102 edge of the ski base 100. Notably, FIG. 9 shows that the edge sharpening device 200 may be oriented differently to facilitate base bevel sharpening (relative to the orientation for side bevel sharpening shown and described herein with reference to FIG. 5). In particular, FIG. 9 illustrates the contact region 806 of the base bevel adapter 802 interfacing with the bottom surface 120 of the ski base 100 and shows the abrasive wheel 204 contacting the base bevel 110 of the ski base 100 so as to sharpen the base bevel 110 in accordance with a desired base bevel angle 112. The guide bearings 212 are also brought into contact with the ski base 100 (or base bevel 110 itself), allowing one or more internal biasing springs of the edge sharpening device 200 to force the abrasive wheel 204 against the base bevel 110 for improved tuning/sharpening.

As noted above, the internal biasing or spring mechanism of the edge sharpening device 200 may be selectively switched to accommodate both side bevel sharpening configurations (where the abrasive wheel 204 is biased in a first direction) and base bevel sharpening configurations (where the abrasive wheel 204 is biased in a second, opposite direction). Under the configuration shown in FIG. 9, a user may hold the main body of the edge sharpening device 200 (e.g., gripping the battery 206) and a gripping region 902 of the base bevel adapter 802 to control the edge sharpening device 200 in a two-handed manner. The user may then cause the edge sharpening device 200 to travel along the length of the ski base 100 (while maintaining contact between the guide bearings 212 and the ski base 100 or base bevel 110) to allow the abrasive wheel 204 to sharpen the length of the base bevel 110 (being forced thereagainst by a spring system of the edge sharpening device 200).

In some implementations, an edge sharpening device 200 is provided (e.g., shipped) to users as an edge sharpening system with one or more angle plates and a base bevel adapter, thereby enabling users to readily reconfigure the edge sharpening device 200 for sharpening side bevels and base bevels.

Figure 10:
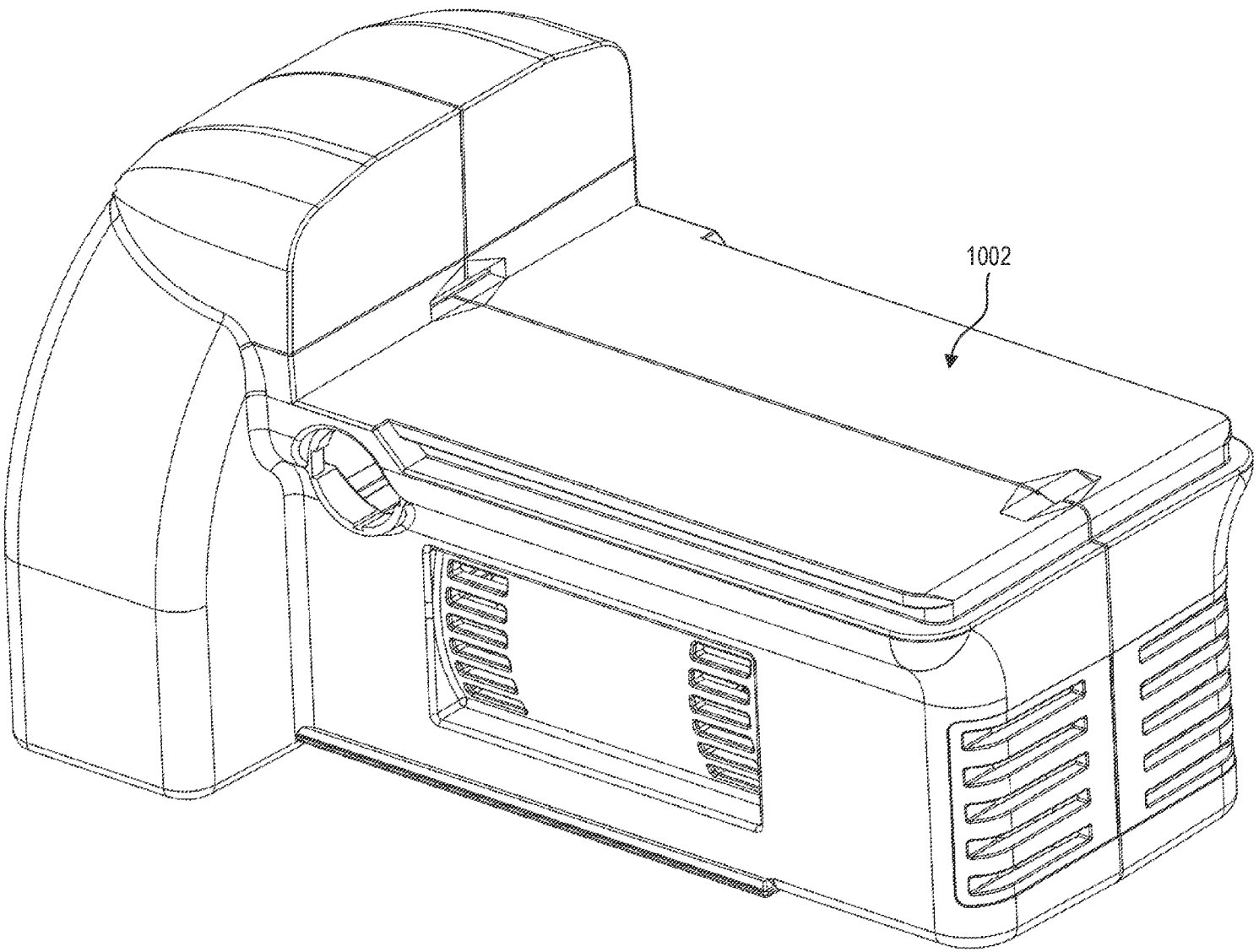
FIG. 10 illustrates a perspective view of a housing of an example edge sharpening device with a battery removed from the battery mount of the housing.

FIG. 10 illustrates an isolated view of the housing 202 of the edge sharpening device 200 with the battery 206 removed to show a battery mount 1002 of the housing 202 that is configured to selectively receive and secure the battery 206 for powering the electric motor 302.

Figure 11:
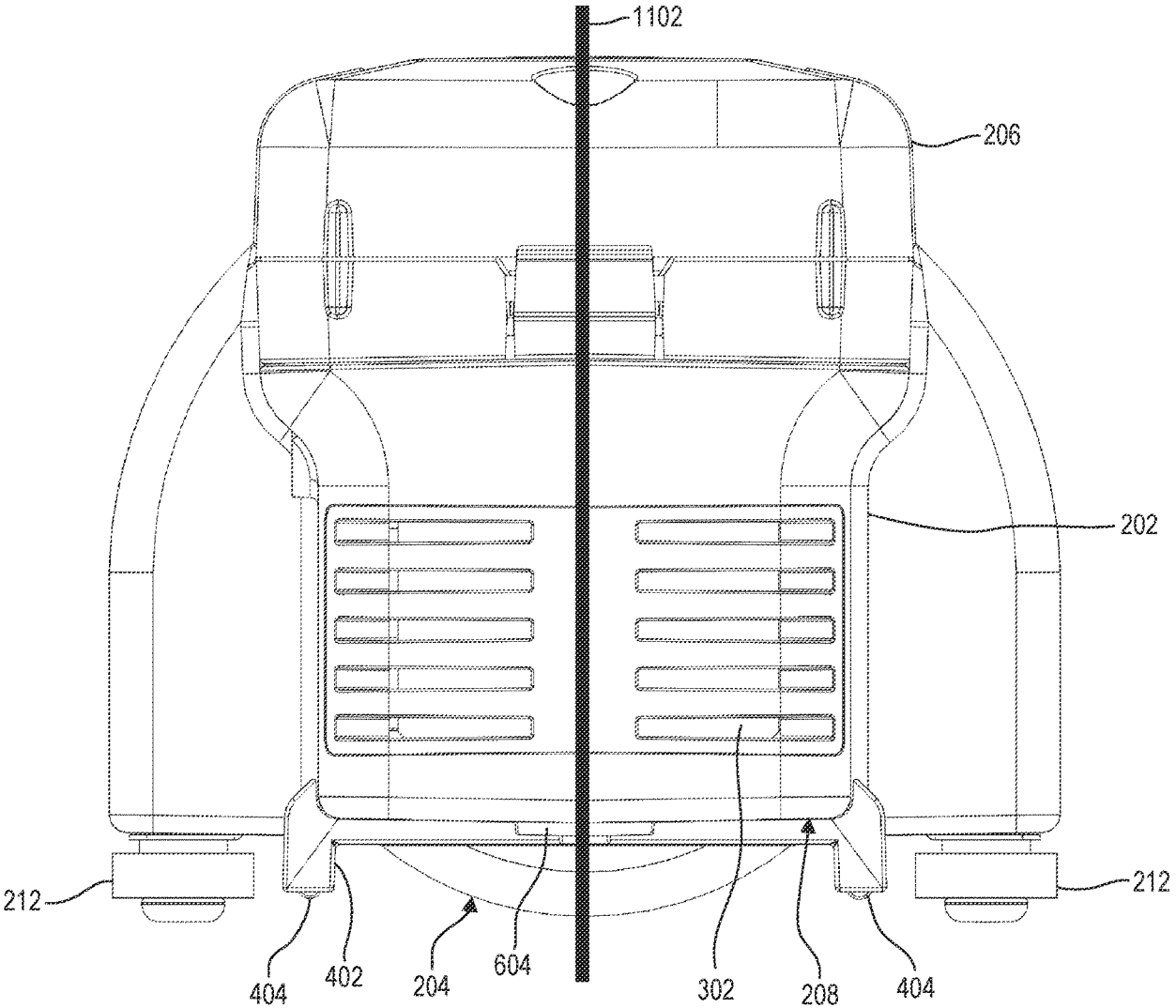
FIG. 11 illustrates a rear view of an example edge sharpening device, illustrating a median plane of the edge sharpening device.

FIG. 11 illustrates a rear view of the edge sharpening device 200, illustrating a median plane 1102 of the edge sharpening device 200. The median plane 1102 divides the edge sharpening device 200 into two generally symmetrical halves. The median plane 1102 is positioned such that it bisects one or more components of the edge sharpening device 200 into two parts that substantially mirror one another in terms of relevant characteristics (e.g., shape, weight, composition, constituent parts, functional or non-ornamental parts, etc.). For instance, the median plane 1102 can bisect the housing 202, abrasive wheel 204, the battery 206, the housing base 208, the spark shield 210, the electric motor 302, the motor shaft 304, the thumb knob 312, the angle plate 402, and/or the retention member 604 into two substantially equal halves. The median plane 1102 can separate the guide bearings 212 and/or the slide rails 404 from one another to cause them to mirror one another.

Figure 12:
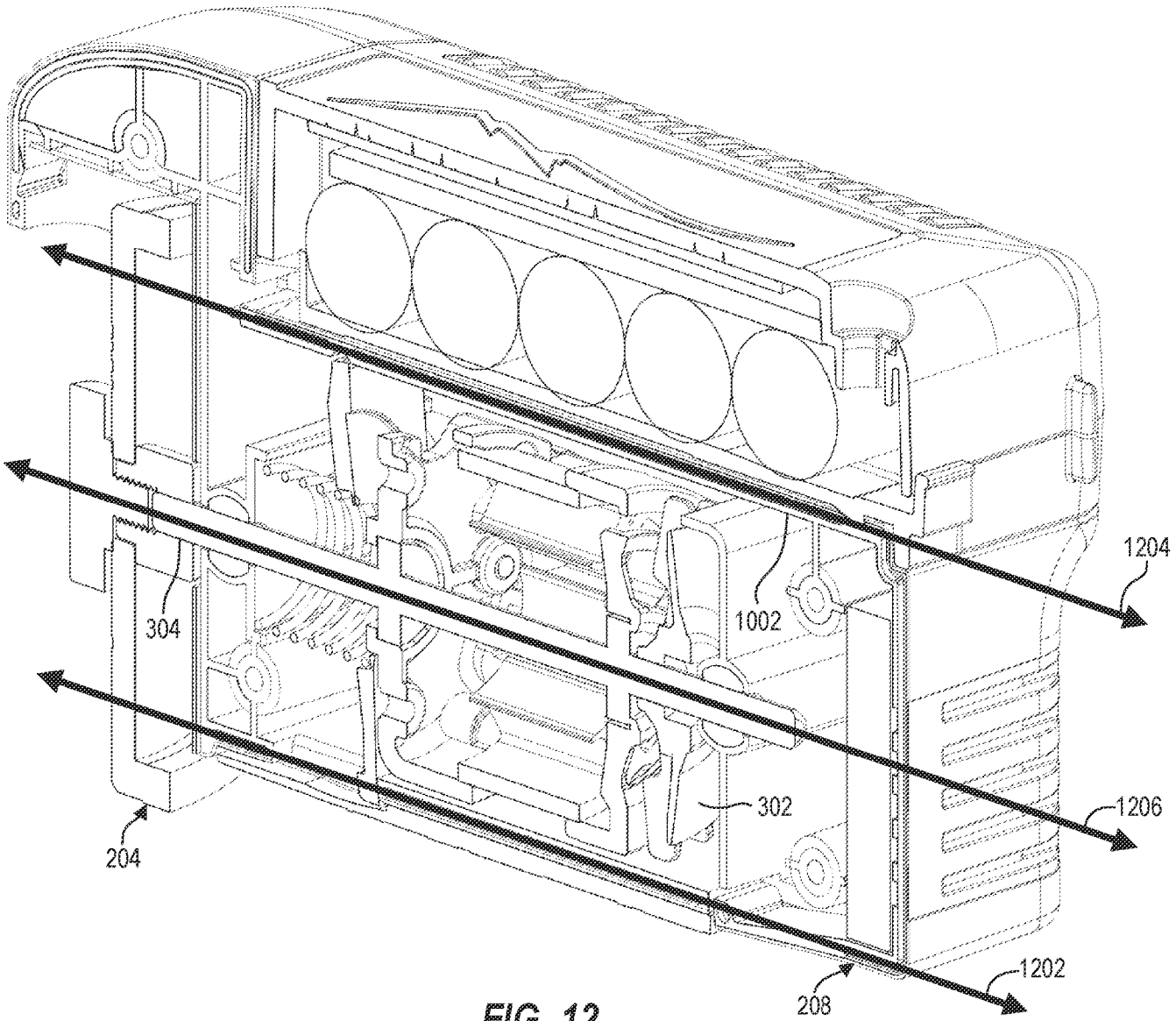
FIG. 12 illustrates a cross-sectional side view of an example edge sharpening device illustrating the alignment of various components along the median plane of the edge sharpening device.

FIG. 12 illustrates a cross-sectional side view of the edge sharpening device 200 that is sectioned along the median plane 1102 described above with reference to FIG. 11. FIG. 11 thus illustrates the alignment of various components of the edge sharpening device 200 along the median plane 1102. For example, FIG. 12 illustrates that a longitudinal axis 1202 of the housing base 208, a longitudinal axis 1204 of the battery mount 1002, and a longitudinal axis 1206 of the electric motor 302 or motor shaft 304 are arranged on the median plane 1102. A longitudinal axis refers to an axis that runs through a center of an object and/or is parallel to the length (or longest dimension in 3-dimensional space) of the object. The longitudinal axis of a part of the edge sharpening device 200 can be regarded as parallel to the rotation axis of the motor shaft 304. Such a configuration can contribute to balance and/or ease of use for users to cause the edge sharpening device 200 to travel along the length of a ski base (e.g., ski base 100) to allow the abrasive wheel 204 to sharpen the length of the side bevel (e.g., side bevel 106) of the ski base.

In the example of FIG. 12, the longitudinal axis 1202 of the housing base 208 and the longitudinal axis 1204 of the battery mount 1002 are arranged on opposing sides of the rotation axis (or longitudinal axis 1206) of the electric motor 302 or motor shaft 304. Other configurations are within the scope of the present disclosure, such as the longitudinal axis 1202 of the housing base 208 and the longitudinal axis 1204 of the battery mount 1002 being on the same side of the rotation axis (or longitudinal axis 1206) of the electric motor 302 or motor shaft 304.

Conclusion

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

What is claimed is:

1. An edge sharpening device, comprising:

an electric motor housed by a housing, wherein a motor shaft extends from the electric motor and is rotatable by the electric motor about a rotation axis, the motor shaft being configured to secure an abrasive wheel, the housing comprising:

a housing base configured to secure a base adapter, the base adapter being configured to rest on a surface of a material comprising an edge to enable the abrasive wheel to contact the edge; and a battery mount configured to secure a battery for powering the electric motor, wherein, when the base adapter rests on the surface of the material and the abrasive wheel contacts the edge, (i) a center of gravity of the edge sharpening device is positioned on a median plane of the edge sharpening device, the median plane being vertically oriented and vertically aligned with a portion of the surface in contact with the base adapter and (ii) the housing base, the electric motor, and the battery mount form a vertical arrangement over the surface of the material comprising the edge.

2. The edge sharpening device of claim 1, wherein a longitudinal axis of the housing base and a longitudinal axis of the battery mount are arranged on opposing sides of the rotation axis of the electric motor.

3. The edge sharpening device of claim 1, wherein the motor shaft is configured to secure the abrasive wheel with an abrasive side of the abrasive wheel facing toward the electric motor to enable the abrasive side to contact the edge when the base adapter rests on the surface of the material comprising the edge.

4. The edge sharpening device of claim 3, wherein the abrasive wheel comprises the abrasive side and a non-abrasive side, or wherein the abrasive wheel comprises two abrasive sides.

5. The edge sharpening device of claim 1, wherein the base adapter is selectively removable from the housing base.

6. The edge sharpening device of claim 1, wherein the base adapter comprises an angle plate that configures the abrasive wheel to contact the edge in accordance with a predetermined sharpening angle when the base adapter rests on the surface of the material comprising the edge.

7. The edge sharpening device of claim 6, wherein the angle plate comprises a plurality of slide rails configured to interface with the surface of the material comprising the edge.

8. The edge sharpening device of claim 1, wherein the edge sharpening device comprises a ski base sharpening device, wherein the material comprising the edge comprise a ski base, and wherein the edge comprises an edge of the ski base.

9. An edge sharpening device, comprising:

an electric motor housed by a housing, wherein a motor shaft extends from the electric motor and is rotatable by the electric motor about a rotation axis, the motor shaft being configured to secure an abrasive wheel, the housing comprising:

a housing base configured to secure a base adapter, the base adapter being configured to rest on a surface of a material comprising an edge to enable the abrasive wheel to contact the edge; and a battery mount configured to secure a battery for powering the electric motor, wherein, when the base adapter rests on the surface of the material and the abrasive wheel contacts the edge, the housing base, the electric motor, and the battery mount form a vertical arrangement such that each of the housing base, the electric motor, and the battery mount is positioned on a median plane of the edge sharpening device, the median plane being vertically oriented and vertically aligned with a portion of the surface in contact with the base adapter.

10. The edge sharpening device of claim 9, wherein, when the base adapter rests on the surface of the material comprising the edge and the abrasive wheel contacts the edge, a center of gravity of the edge sharpening device is positioned over the surface of the material comprising the edge.

11. The edge sharpening device of claim 9, wherein the motor shaft is configured to secure the abrasive wheel with an abrasive side of the abrasive wheel facing toward the electric motor to enable the abrasive side to contact the edge when the base adapter rests on the surface of the material comprising the edge.

12. The edge sharpening device of claim 9, wherein the base adapter is selectively removable from the housing base.

13. The edge sharpening device of claim 9, wherein the base adapter comprises an angle plate that configures the abrasive wheel to contact the edge in accordance with a predetermined sharpening angle when the base adapter rests on the surface of the material comprising the edge.

14. The edge sharpening device of claim 13, wherein the angle plate comprises a plurality of slide rails configured to interface with the surface of the material comprising the edge.

15. The edge sharpening device of claim 9, wherein the edge sharpening device comprises a ski base sharpening device, wherein the material comprising the edge comprise a ski base, and wherein the edge comprises an edge of the ski base.

16. A ski sharpening device, comprising:

an electric motor housed by a housing, wherein a motor shaft extends from the electric motor and is rotatable by the electric motor about a rotation axis, the motor shaft being configured to secure an abrasive wheel, the housing comprising:

a housing base configured to secure a base adapter, the base adapter being configured to rest on a surface of a ski base comprising a side bevel to enable the abrasive wheel to contact the side bevel; and a battery mount configured to secure a battery for powering the electric motor, wherein, when the base adapter rests on the surface of the ski base and the abrasive wheel contacts the side bevel, a center of gravity of the ski sharpening device and a center of gravity of the battery are each positioned along a direction of gravitational force above a portion of the surface of the ski base in contact with the base adapter.

* * * * *